United States Patent [19]

Leis

[11] Patent Number: 4,498,896

[45] Date of Patent: Feb. 12, 1985

[54] HEATABLE CENTRIFUGE

[75] Inventor: Hans Leis, Ottobrunn, Fed. Rep. of Germany

[73] Assignee: Messerschmitt-Bölkow-Blohm, Munich, Fed. Rep. of Germany

[21] Appl. No.: 624,263

[22] Filed: Oct. 21, 1975

[30] Foreign Application Priority Data

Oct. 24, 1974 [DE] Fed. Rep. of Germany ..... 2450482

[51] Int. Cl.[3] ..... B04B 15/02; B04B 15/08

[52] U.S. Cl. ..... 494/14; 494/13; 494/16; 494/25; 494/61; 494/81

[58] Field of Search ..... 233/1 R, 11, DIG. 1, 233/26; 102/DIG. 4; 494/13, 14, 25, 33, 39, 81

[56] References Cited

U.S. PATENT DOCUMENTS

| | | | |
|---|---|---|---|
| 2,551,815 | 5/1951 | Schulz | 102/DIG. 4 |
| 2,628,773 | 2/1953 | Boileau | 233/11 |
| 3,289,925 | 12/1966 | Zippe et al. | 102/DIG. 4 |
| 3,347,453 | 10/1967 | Goergen | 233/11 |
| 3,600,900 | 8/1971 | Buddecke | 233/11 X |

OTHER PUBLICATIONS

Beams et al.: "Electrically-Driven Magnetically-Supported Vacuum-Type Ultracentrifuge", in Review of Scientific Instruments, vol. 10, Feb., 1939, pp. 59-63.

*Primary Examiner*—Richard D. Lovering
*Attorney, Agent, or Firm*—Toren, McGeady and Stanger

[57] ABSTRACT

A heatable centrifuge is formed of a rotor rotatable about a central axis. The rotor includes a dish shaped portion concentric to the central axis and a jacket portion extending upwardly from the outer peripheral edge of the dish shaped portion and disposed in parallel with the central axis. Preferably, the dish shaped portion is formed of an electrically insulating and heat insulating ceramic material and the jacket portion is formed of a high strength electrically conductive material. Sample containers are symmetrically arranged with the rotor supported with an insert within the jacket portion. Conductive heating members, such as electro-magnets, are arranged about the outer surface of the jacket portion for transmitting heat through the jacket portion to the material being centrifuged.

16 Claims, 3 Drawing Figures

Fig.1
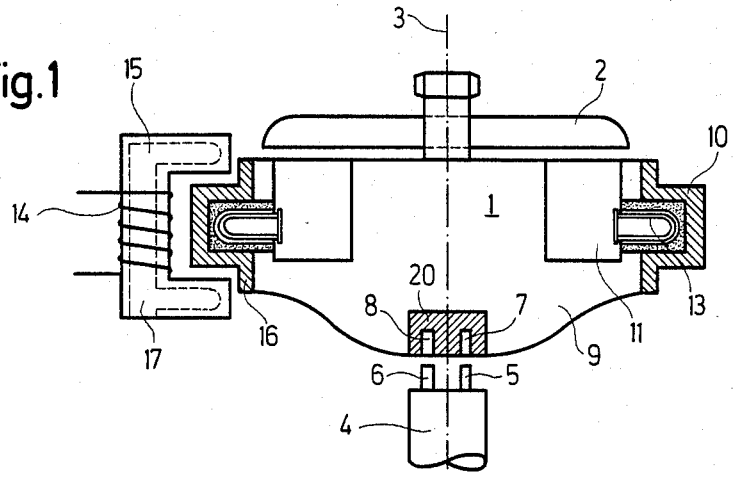
Fig.2
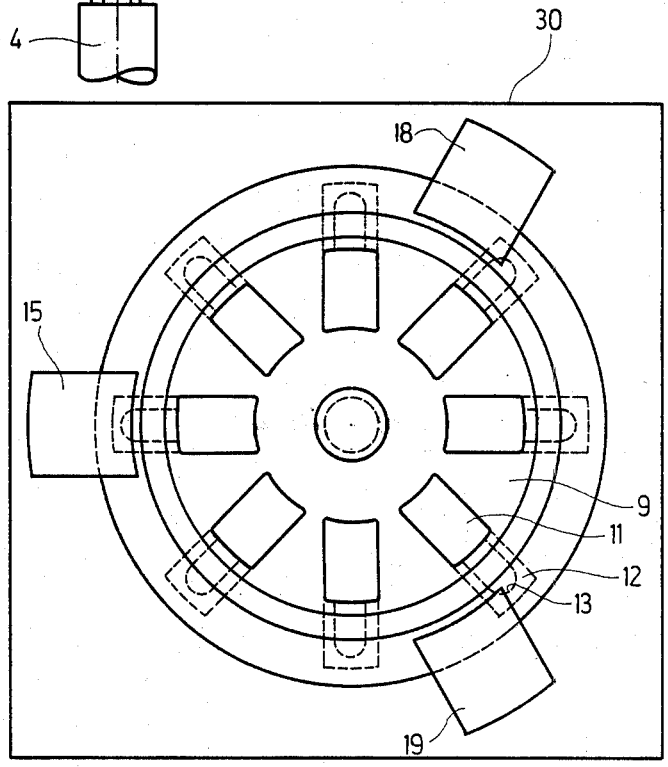
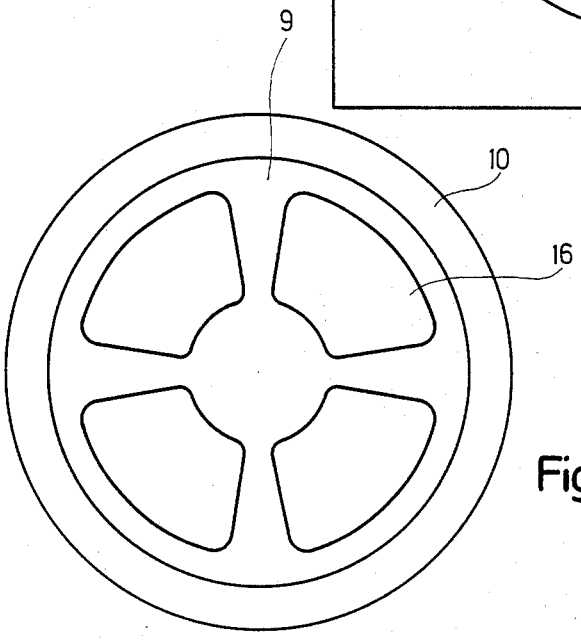
Fig.3

HEATABLE CENTRIFUGE

SUMMARY OF THE INVENTION

The present invention is directed to a heatable centrifuge for the separation of heterogenous mixtures for carrying out, among others, solid reactions or the like under extreme mechanical and thermal conditions.

In conventional centrifuges it is known to heat the material being centrifuged. For example, in such known arrangements, a layer of the material being centrifuged is heated utilizing the friction heat generated during the operation of the centrifuge.

In another type of centrifuge which has a drum open at the bottom, it is known to incorporate a pipe or tube which has fine holes, perforations, slots or the like. Steam, hot air or a hot liquid can be passed through the pipe and directed against the wall of the centrifuging drum for heating the material being centrifuged.

In another known centrifuge the centrifuging drum has been constructed as an electrode for electrical heating with high frequency. In such an arrangement, a rod shaped counter electrode is arranged in a stationary position and projects into the interior of the drum to a position adjacent the rotating drum wall, see German Auslegeschrift No. 1,181,135.

In these known constructions, trouble free centrifuging of material is prevented by introducing a heating source into the interior of the centrifuging drum in either a direct or indirect manner. In the direct introduction of heat, hot steam or the like is introduced into the drum interior. In any event, trouble free operation of the centrifuge is strongly endangered if an electrode is used which freely projects into the interior of the drum particularly during the start up of centrifuging operations, since it is capable of contacting the material layer being centrifuged providing the layer with an uneven thickness.

Therefore, the primary object of the present invention is to overcome the disadvantages experienced in the known heated centrifuges by providing a heatable centrifuge for separating heterogeneous mixtures or for causing reactions or the like, for the occurrence of which the effect of centrifugal force is preconditioned with simultaneous high temperature.

In accordance with the present invention, the heatable centrifuge includes a rotor formed of an electrically insulating and heat insulating dish shaped body and a rim extending outwardly from the dish shaped body which is formed of a high strength and electrically conductive material. Heating means are provided around the exterior of the rotor adjacent the jacket portion for transmitting heat through the jacket portion to the material being centrifuged.

An important feature of the invention is that the dish shaped body has a flatly curved bottom surface formed of a ceramic material, such as silicon nitride ($Si_3N_4$). Further, an annular part of the jacket portion is formed in a projecting manner, that is, it forms an annular recess containing graphite or silicon into which sample containers are imbedded. The interior of the rotor can be inductively heated by transmitting heat through the jacket portion.

Due to the projecting shape of the jacket portion of the centrifuging drum or rotor, the centrifugal forces which act on the material to be centrifuged are increased because of the enlarged diameter of the drum.

Another feature of the invention is the arrangement of the sample containers which extend inwardly from the jacket portion over the dish shaped body of the rotor or drum. As a result, the containers are subjected to the mass forces which are larger in the peripheral or rim regions of the rotor.

The projecting configuration of the rim or jacket portion of the rotor or centrifuging drum also facilitates the use of inductive heating as the mode of heating used in accordance with the present invention. For example, a formation of U-shaped electromagnets is arranged concentrically of the central axis of the rotor in juxtaposition to the outer surface of the rim or jacket portion so that the sample containers which extend into the recess formed by the projecting configuration of the jacket portion, are subjected to the flux of the magnetic field and thus particularly effectively heated in inductive manner.

In this manner, during centrifuging of predetermined mixtures of material, for example, the density gradients which are produced or generated in melt-liquid condition, can be exactly analyzed when the cold or solidified condition has again been reached.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive material in which there are illustrated and described preferred embodiments of the invention.

BRIEF DESCRIPTION OF THE DRAWING

In the Drawing

FIG. 1 is a diagrammatic view, partially in section, of an inductively heated rotor or drum of a centrifuge embodying the present invention;

FIG. 2 is a plan view of the rotor of FIG. 1, however, without its cover; and FIG. 3 is a plan view of another embodiment of sample containers positioned within the rotor.

DETAIL DESCRIPTION OF THE INVENTION

The rotor or centrifuging drum or vessel 1 has a dishlike outer shape and a cover or lid 2. The rotor is rotatably mounted about a central axis 3. Rotational drive is imparted to the rotor through a shaft 4 and follower pins 5 and 6, the shaft being connected to a drive motor not shown. The follower pins 5 and 6 engage in corresponding recesses in the lower portion of a metallic insert 20 which is incorporated into the lower part of the rotor 1. Instead of using follower pins 5 and 6, the rotational drive can be transmitted by means of a magnetic coupling or the like.

The rotor consists of a central body 9 concentrically arranged about the central axis 3 and a rim or jacket part or portion 10 defining the radially outer periphery of the space within the rotor. Central body 9 is formed of ceramic material and has a dish or plate-like bottom surface, that is, its lower or outer surface has a convex appearance. The rim or jacket portion 10 is formed of a high strength, heat resistant and electrically conductive material. The walls of the jacket part 10 extending upwardly from the outer circumferential periphery of the central body are disposed parallel with the central axis 3 about which the rotor rotates. As can be noted in FIG. 1, between its upper and lower ends, the jacket part 10 has an annular recess formed by a part which projects or extends radially outward relative to the central axis.

In FIG. 1, sample containers 11 are arranged within the rotor above the central body 9. The containers are uniformly distributed around the interior of the jacket part 10. The sample containers extend outwardly from over the central body 9 into the annular recess or groove formed by the projecting part of the jacket portion 10 and in the recess are preferably embedded in silicon nitride or in graphite 12.

In the embodiment shown, cylindrical vessels 13 formed of platinum foil or another high melting and non-reactive material are inserted into the sample containers 11. These vessels 13 serve to receive and subsequently for the discharge of the material being centrifuged.

In forming the containers 11 with their inserted vessels 13 it is advantageous to choose material having approximately the same expansion coefficient as that of the surrounding materials.

The configuration or shape of the sample containers may be effected in a different manner. For example, FIG. 3 shows a sample container 16 which has a different form with a substantially larger inner surface, that is, with large receiving capability and without having special vessels inserted therein.

For the inductive heating of the rim or jacket portion 10 of the rotor 1, electromagnets 15 (FIG. 1) or 15, 18 and 19 (FIG. 2) are arranged in juxtaposition to the outer surface of the outwardly projecting part of the jacket portion. The electromagnets are arranged concentrically about the outer circumference of the jacket portion 10 and are uniformly spaced apart about the rotor 1 with a winding 14 being provided through which current passes. The magnet has a pair of spaced inwardly projecting legs extending inwardly in opposed relationship to the upper and lower surfaces of the projecting part of the jacket portion. Magnetic force lines pass between the legs of each magnet through the projecting part of the jacket portion causing a heating of the jacket portion 10.

As shown in FIG. 1, each of the electromagnets 15, 18 and 19 is provided with recesses 17 for the flow through the magnet of a cooling fluid. Though FIG. 1 shows only magnet 15 a similar construction is provided for the other magnets 18 and 19 shown in FIG. 2. The required heating values may, however, also be obtained by using only two or using four or more of the electromagnets. In order to avoid any unbalance in the rotor 1 it is considered important to arrange the magnets symmetrically about the jacket portion 10.

Another feature of the invention is to arrange both the rotor and the heating means in a vacuum or in a protective gas atmosphere, (chamber 30, FIG. 2).

Preferably, water is used as the cooling fluid flowing through the recesses 17 in the electromagnets.

To enhance the operation of the rotor arrangement described above, it is advisable to surround the rotor with a heat radiation element.

While specific embodiments of the invention have been shown and described in detail to illustrate the application of the inventive principles, it will be understood that the invention may be embodied otherwise without departing from such principles.

What is claimed is:

1. A heatable centrifuge comprising a rotor including a first portion and a second portion, said first portion having a central axis about which said first and second portions are rotatable, said first portion extends transversely of the central axis, said second portion is annular in shape and is secured to said first portion radially outwardly from and concentric to the central axis, said first portion being formed of an electrically insulating and heat insulating material, said second portion being formed of a high strength electrically conductive material, and means arranged for supplying heat energy to said second portion from a location exteriorly of said rotor.

2. A heatable centrifuge, as set forth in claim 1, wherein said first portion is formed of a ceramic material.

3. A heatable centrifuge, as set forth in claim 2, wherein said first portion is formed of silicon nitride.

4. A heatable centrifuge, as set forth in claim 1, wherein said first portion is a dish shaped member.

5. A heatable centrifuge, as set forth in claim 4, wherein an insert is centrally positioned in said dish shaped member on the central axis and is arranged to be connected to a rotational drive, said insert being formed of a metallic material.

6. A heatable centrifuge, as set forth in c1aim 4, wherein said second portion is a jacket member secured to the radially outer peripheral edge of said dish shaped member ahd extending outwardly from said dish shaped member in parallel with the central axis.

7. A heatable centrifuge, as set forth in claim 6, wherein a plurality of sample containers are located within said rotor extending inwardly from said jacket member over said dish shaped member.

8. A heatable centrifuge, as set forth in claim 7, wherein said jacket member has a projecting part extending radially outwardly from the radially outer peripheral edge of said dish shaped member and forming an inwardly facing annular shaped recess, an insert of graphite positioned within said recess in said jacket member, and said sample container embedded within said graphite.

9. A heatable centrifuge, as set forth in claim 7, wherein said jacket member has a projecting part extending radially outwardly from the radially outer peripheral edge of said dish shaped member and forming an inwardly facing annular shaped recess, an insert of silicon nitride positioned within said recess in said jacket member, and said sample container embedded within said silicon nitride.

10. A heatable centrifuge, as set forth in c1aim 6, wherein said means for supplying energy comprising a plurality of members for inductively heating said jacket member.

11. A heatable centrifuge, as set forth in claim 10, wherein said members for inductively heating comprise electromagnets symmetrically distributed around the outer surface of said jacket member and spaced angularly apart with said electromagents disposed in juxtaposition to the projecting part of said jacket member.

12. A heatable centrifuge, as set forth in claim 11, wherein said means include cooling means for said electromagnets.

13. A heatable centrifuge, as set forth in claim 12, wherein said cooling means comprise conduits positioned within said electromagnets for circulating a cooling fluid through said magnets.

14. A heatable centrifuge, as set forth in claim 1, wherein a heat radiation element encloses said rotor.

15. A heatable centrifuge, as set forth in claim 1, including means for enclosing said rotor and said means for supplying energy for carrying out the centrifuging operations under vacuum conditions.

16. A heatable centrifuge, as set forth in claim 1, including means for enclosing said rotor and said means for supplying energy for carrying out the centrifuging operations in a protective gas atmosphere.

* * * * *